US005793263A

United States Patent [19]

Pozar

[11] Patent Number: 5,793,263

[45] Date of Patent: Aug. 11, 1998

[54] WAVEGUIDE-MICROSTRIP TRANSMISSION LINE TRANSITION STRUCTURE HAVING AN INTEGRAL SLOT AND ANTENNA COUPLING ARRANGEMENT

[75] Inventor: David M. Pozar, Leverett, Mass.

[73] Assignee: University of Massachusetts, Boston, Mass.

[21] Appl. No.: 649,322

[22] Filed: May 17, 1996

[51] Int. Cl.[6] ..... H01P 5/107

[52] U.S. Cl. ..... 333/26; 333/33

[58] Field of Search ..... 333/26, 33; 343/772, 343/767

[56] References Cited

U.S. PATENT DOCUMENTS

| | | | |
|---|---|---|---|
| 5,043,683 | 8/1991 | Howard | 333/26 X |
| 5,337,065 | 8/1994 | Bonnet et al. | 343/767 |
| 5,396,202 | 3/1995 | Scheck | 333/26 X |
| 5,539,361 | 7/1996 | Davidovitz | 333/26 |

FOREIGN PATENT DOCUMENTS

| | | | |
|---|---|---|---|
| 843042 | 6/1981 | U.S.S.R. | 333/21 A |

OTHER PUBLICATIONS

D.M. Pozar, Jan. 17, 1985, "Microstrip Antenna Aperture–Coupled to a Microstripline", Electronics Letters, vol. 21, pp. 49–50.

Naftali Herscovici, Sep. 1993, "A New Waveguide–to–Microstrip Transition", Proceedings of the 1993 Antenna Applications Symposium, pp. 189–194.

*Primary Examiner*—Benny T. Lee
*Attorney, Agent, or Firm*—Fish & Richardson P.C.

[57] ABSTRACT

A waveguide-microstrip transmission line transition structure is provided having a microstrip transmission line structure adapted for coupling to an open end of a waveguide. The microstrip transmission line structure includes a microstrip transmission line having a ground plane conductor and an antenna electrically coupled to the microstrip transmission line through an aperture in the ground plane conductor. The ground plane conductor is adapted for mounting in a plane intersecting a longitudinal axis of the waveguide. The antenna provides impedance matching between the microstrip transmission line and the waveguide. With such an arrangement, a relatively simpler manufacturable structure is provided because it is adapted for mounting to a standard waveguide flange and does not require specially machined waveguide pieces. The arrangement also provides modularity, in that the waveguide can be easily connected to and disconnected from the microstrip transmission line structure. Still further, the transition section does not require any special openings in the waveguide, thus eliminating spurious radiation and providing hermiticity. The structure is particularly well-suited for connecting planar antennas to waveguide feeds.

9 Claims, 4 Drawing Sheets

WAVEGUIDE-MICROSTRIP TRANSMISSION LINE TRANSITION STRUCTURE HAVING AN INTEGRAL SLOT AND ANTENNA COUPLING ARRANGEMENT

BACKGROUND OF THE INVENTION

This invention relates generally to waveguide-microstrip transmission line transition structures.

As is known in the art, many applications require that a waveguide and microstrip transmission line be coupled together. A structure used for such coupling is a transition structure, sometimes merely referred to as a "transition". Such transitions have taken a variety of forms. In one type of transition, the microstrip transmission line is inserted perpendicularly into a slot or opening in the broad, or wide, wall of the waveguide. The resulting structure is non-planar and requires specially machined parts. In another type of transition, the microstrip transmission line is inserted co-linearly into the open end of the waveguide. However, while the resulting waveguide-microstrip transmission line structure is co-planar, the structure is relatively fragile in construction. Further, the possibility of spurious radiation from the waveguide opening is possible. In another arrangement, the transition uses a waveguide mounted perpendicular to the microstrip transmission line ground plane; however, a small wire loop is required to connect the microstrip transmission line to the waveguide wall.

SUMMARY OF THE INVENTION

In accordance with the present invention, a waveguide-microstrip transmission line transition structure is provided having a planar microstrip transmission line structure adapted for coupling to an open end of a waveguide. The microstrip transmission line structure includes a microstrip transmission line having a ground plane conductor and an antenna electrically coupled to the microstrip transmission line through an aperture in the ground plane conductor. The ground plane conductor is adapted for mounting in a plane intersecting a longitudinal axis of the waveguide (i.e., a plane intersecting the direction of propagation of energy through the waveguide).

In a preferred embodiment, the aperture is a slot, the ground plane conductor is perpendicular to the longitudinal axis of the waveguide, and the antenna is a patch antenna configured to provide impedance matching between the waveguide and the microstrip transmission line.

With such an arrangement, a relatively simpler manufacturable structure is provided because it is adapted for mounting to a standard waveguide flange and does not require specially machined waveguide pieces. The arrangement also provides modularity, in that the waveguide can be easily connected to and disconnected from the microstrip transmission line structure. Still further, the transition section does not require any special openings in the waveguide, thus eliminating spurious radiation and providing hermiticity. The structure is particularly well-suited for connecting planar antennas to waveguide feeds.

BRIEF DESCRIPTION OF THE DRAWINGS

Other features of the invention, as well as the invention itself, will become more readily apparent from the following detailed description when read together with the accompanying drawings, in which.

DESCRIPTION OF THE PREFERRED EMBODIMENTS

Figure 1:
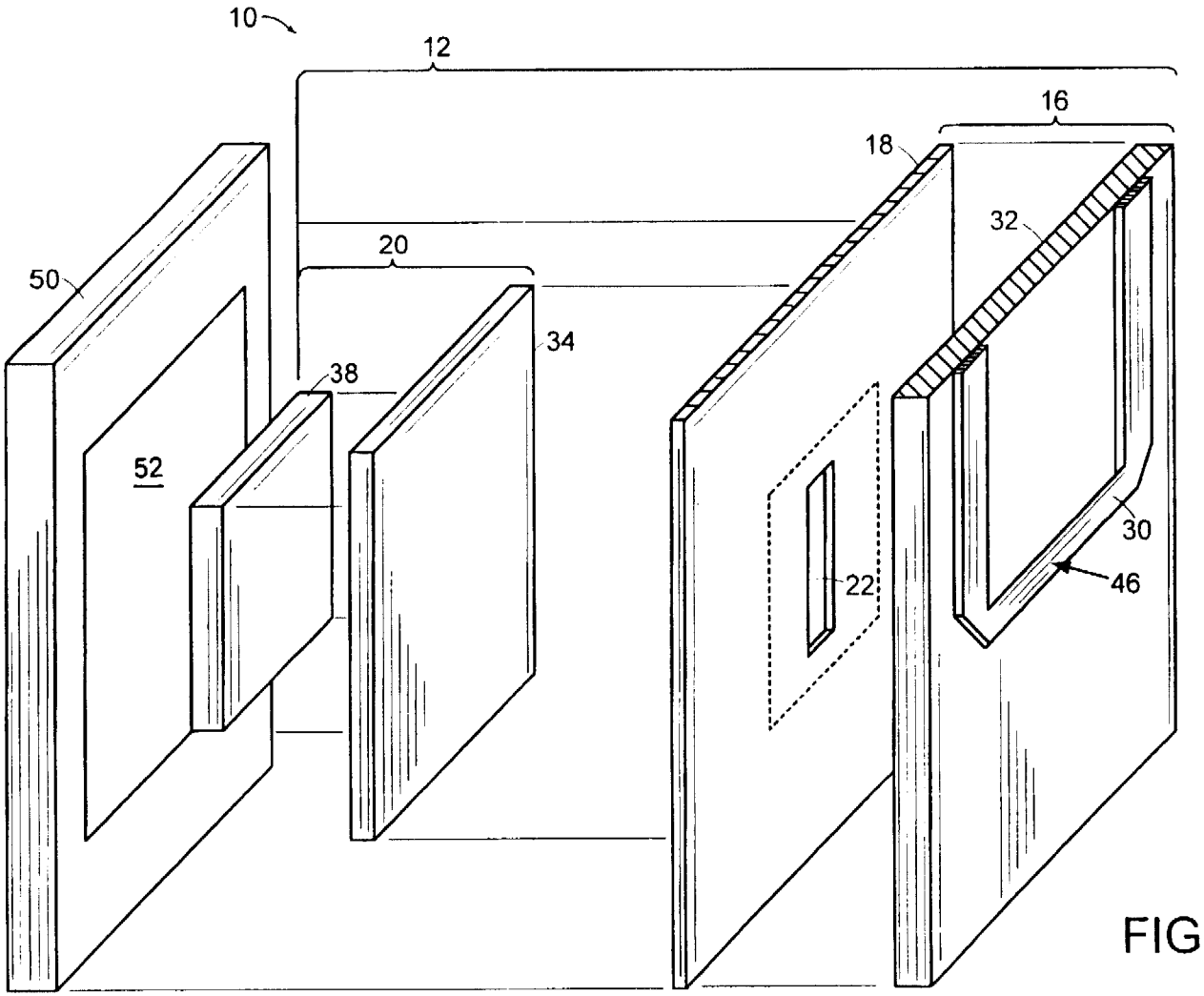
FIG. 1 is an exploded, isometric view of a waveguide-microstrip transmission line structure according to the invention.
Figure 4:
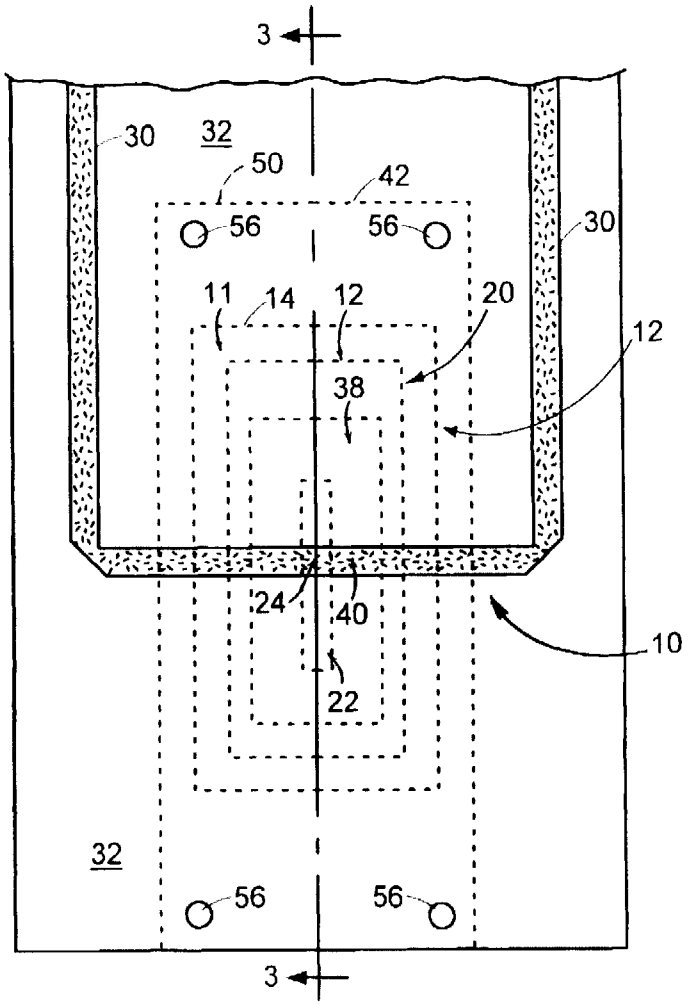
FIG. 4 is a plan view of the waveguide-microstrip transmission line structure of FIG. 3, the cross section for FIG. 3 being along line 3—3 of FIG. 4.
Figure 3:
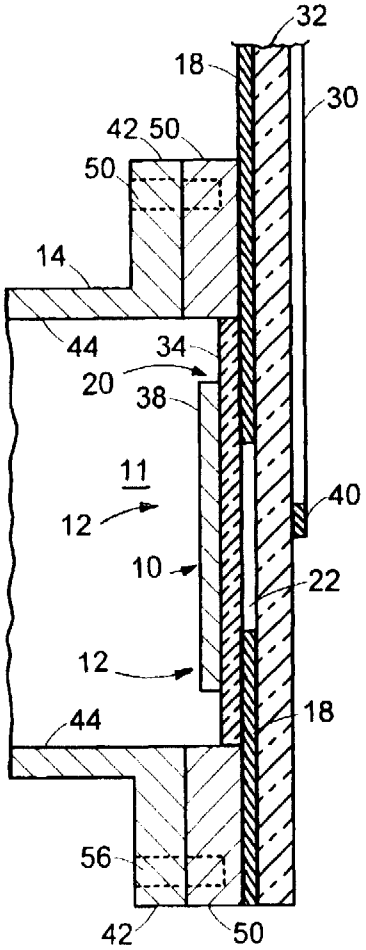
FIG. 3 is a cross-sectional elevation view of the waveguide-microstrip transmission line structure of FIG. 1 and a waveguide mounted thereto.
Figure 2:
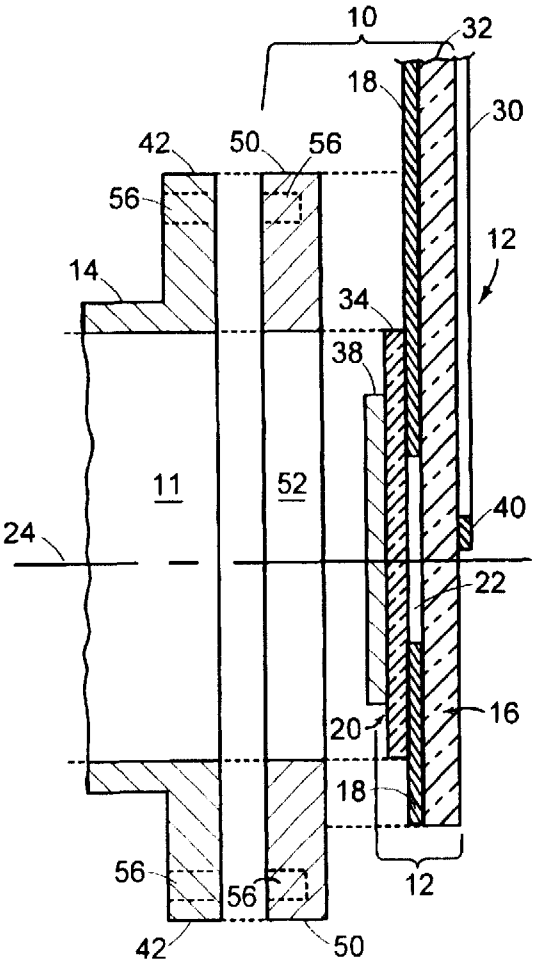
FIG. 2 is an exploded cross-sectional elevation view of the waveguide-microstrip transmission line structure of FIG. 1 and a waveguide mounted thereto.

Referring now to FIG. 1, a waveguide-microstrip transmission line transition structure 10 is shown. The structure 10 includes a microstrip transmission line assembly, or structure 12 adapted for coupling to an open end of a waveguide 14, as shown in FIGS. 2, 3 and 4. The microstrip transmission line assembly, or structure 12 includes: (a) a microstrip transmission line 16 having a ground plane conductor 18; and, (b) a microstrip antenna element 20, here a patch antenna element, electrically coupled to the microstrip transmission line 16 through an aperture, here a slot 22 formed in the ground plane conductor 18. Here, for example, the patch antenna element 20 may be one similar to that described in my paper entitled "Microstrip antenna aperture coupled to a microstripline", published in *Electronics Letters*, Vol. 21, pp. 49–50, Jan. 17, 1985. The ground plane conductor 18 is adapted for mounting in a plane intersecting a longitudinal axis 24 of the waveguide. Here, the ground plane conductor 18 is adapted for mounting in a plane perpendicular to the longitudinal axis 24 of the waveguide 14 (i.e., perpendicular to the direction of propagation of energy through the waveguide) as shown in FIG. 2. The microstrip transmission line 16 is formed using conventional photolithographic-chemical etching techniques. The antenna 20 is configured to provide impedance matching between the waveguide 14 and the microstrip transmission line 16.

More particularly, the microstrip transmission line 16 has a strip conductor 30 separated from the ground plane conductor 18 by a dielectric substrate 32. The ground plane conductor 18 has an aperture, here the slot 22, formed therethrough using conventional photolithographic-etching techniques. The antenna element 20 includes a conductor 38 separated from the ground plane conductor 18 of the microstrip transmission line 16 by a dielectric substrate 34, as shown. The conductor 38 of the antenna element 20 is disposed in registration with the slot 22. More particularly the conductor 38 is centered with respect to the slot 22 so as to lay over the slot 22. Thus, with such an arrangement, the antenna element 20 is electrically coupled to the strip transmission line 16 via the slot 22. Here, the slot 22 has a longitudinal axis which intersects a portion 40 of the strip conductor 30 disposed in registration with, i.e., over, such slot 22, as shown in FIG. 4. Here, the longitudinal axis of the slot 22 is perpendicular to the portion 40 of the strip conductor 30.

The ground plane conductor 32 is adapted for electrical connection and mounting to an end of the waveguide 14, as shown in FIGS. 2–4. More particularly, the waveguide-microstrip transmission line transition structure 10 is a modular structure adapted for mounting to a mounting flange 42 (FIGS. 2, 3 and 4) of the waveguide 14. It is also noted from FIG. 3, that the antenna element 20, i.e., conductor 38, is disposed with the conductive walls 44 of the waveguide 14 when the waveguide-microstrip transmission line transition structure 10 is mounted to the waveguide 14. Here, a conductive ground plane plate 50, having a thickness greater than the thickness of the ground plane conductor 18, is provided for increasing the structural integrity of structure 10 particularly where it is desired to mount the structure 10 to the mounting flange 42 by screws, not shown, adapted for passing through holes 56 provided in the flange 42 and ground plane plate 50, as shown in FIG. 2–4.

Thus, the transition structure 10 as shown in FIG. 1 has four pieces: microstrip transmission line 16; dielectric layer 34; conductor 38; and, ground plate 50. The microstrip transmission line 16 is mounted on the thicker ground plate 50. The shape of the aperture 52 in the ground plate 50 corresponds to the cross-section of the opening 11 in waveguide 14, as shown in FIGS. 2 and 3. Inside aperture 52, and mounted against the ground plane conductor 18 is the dielectric layer 34. The size and shape of the dielectric layer 34 is the same as the size and shape of the aperture 52 and the opening 11, as shown in FIGS. 2 and 3. Here, the waveguide 14 has a rectangular cross section as shown in FIG. 4. Thus, when the structure 10 in FIG. 1 is mounted to the 14 flange 42 of waveguide 14, the dielectric layer 34 and conductor 38 are disposed within the inner walls 44 of the waveguide 14, as shown in FIG. 3. The dielectric layer 34 makes ground plate 50 and attached waveguide 14 self-aligned with the rest of the elements of the transition structure 10, i.e., the patch antenna 20, slot 22 and the portion 40 of the strip conductor 30 as shown in FIGS. 2 and 3.

More particularly, the structure 10 (FIG. 2) is here formed as module; the dielectric layer 34 is bonded to the ground plane conductor 18 with a suitable adhesive, (FIGS. 2 and 3) such as an epoxy, not shown. The conductor 38 may be bonded to, or patterned on, dielectric layer 34 using conventional photolithographic-chemical etching techniques. The structure thus formed, i.e., the microstrip transmission line 16-dielectric layer 34-conductor 20, is then affixed to the ground plate 50 with, for example, a conductive epoxy, or if a hermetic seal is desired with the flange 42, of waveguide 14 by solder.

Here, in one embodiment, the dielectric constant of dielectric layer 32 is 2.2; the thickness of such layer 32 is 0.0238λ, where λ is the nominal operating wavelength of the transition structure 10; the microstrip transmission line 16 is here a 50 ohm line and the strip conductor 30 has a width of 0.073λ, the dielectric constant of dielectric layer 34 is 2.2, the thickness of dielectric layer 34 is 0.0238λ, the length of the conductor 38 is 0.28λ, the width of the conductor 30 is 0.300λ, the length of slot 22 is 0.165λ, the width of the slot 22 is 0.015λ, the inside width of the rectangular waveguide 14 is 0.713λ, and the inside height of the waveguide 14 is 0.322λ. Here λ is 6.67 centimeters. With such configuration, the antenna 22 provides impedance matching between the waveguide 14 and the microstrip transmission line 16.

Figure 5:
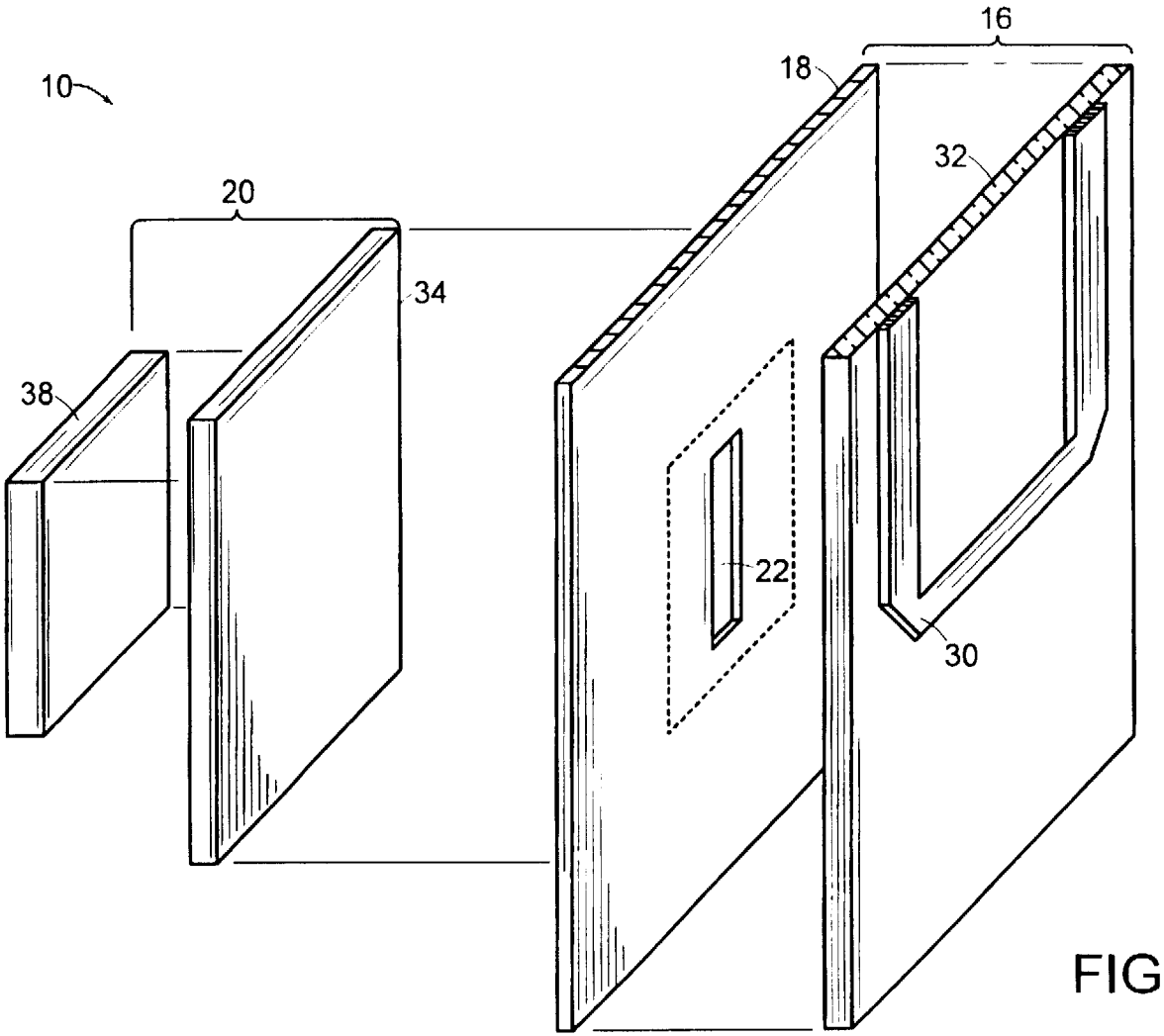
FIG. 5 is an exploded, isometric view of a waveguide-microstrip transmission line structure according to an alternative embodiment of the invention.
Figure 8:
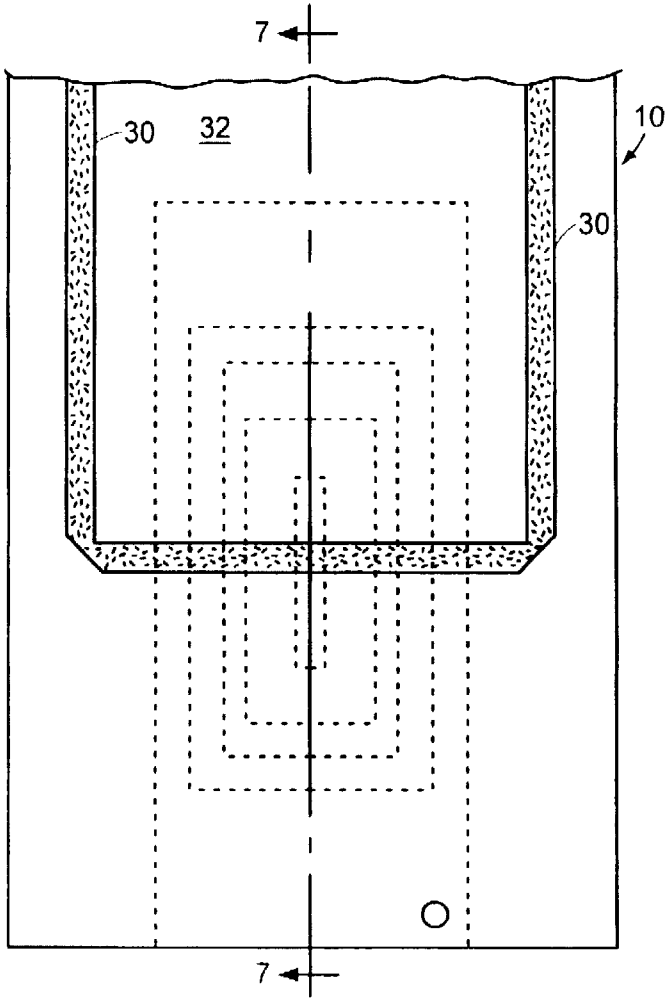
FIG. 8 is a plan view of the waveguide-microstrip transmission line structure of FIG. 7, the cross section for FIG. 7 being along line 7—7 of FIG. 8.
Figure 7:
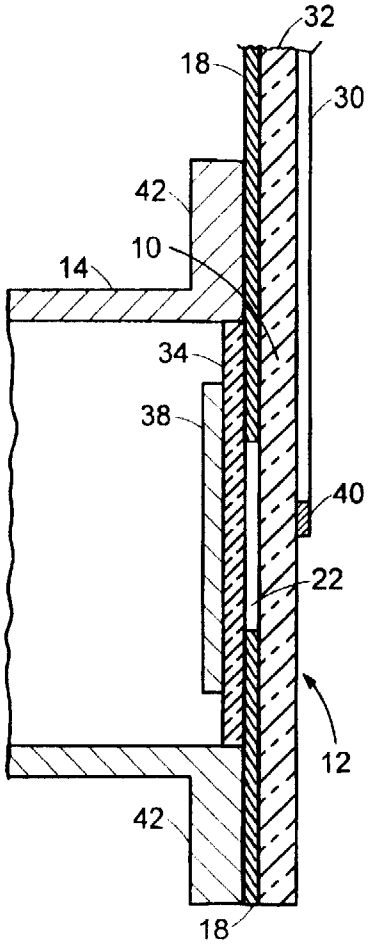
FIG. 7 is a cross-sectional elevation view of the waveguide-microstrip transmission line structure of FIG. 5 and a waveguide mounted thereto.
Figure 6:
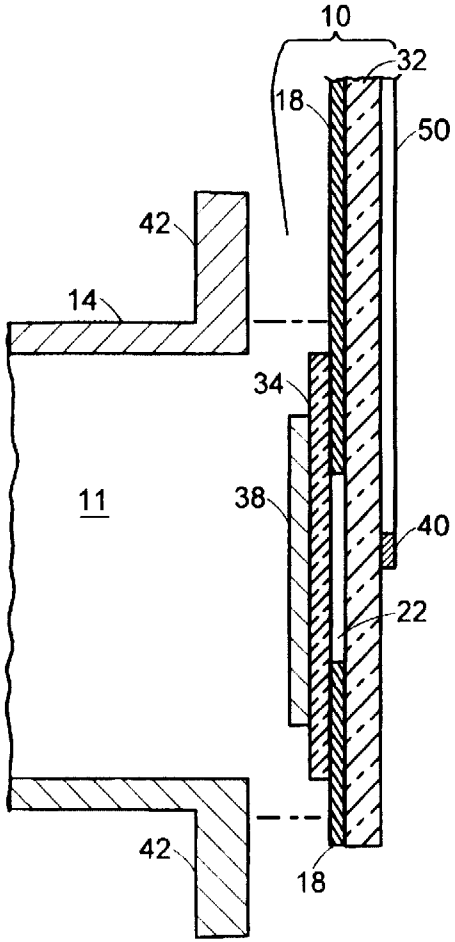
FIG. 6 is an exploded cross-sectional elevation view of the waveguide-microstrip transmission line structure of FIG. 5 and a waveguide mounted thereto.

Referring now to FIGS. 5 through 7 an alternative embodiment of the invention is shown with like parts being designated with like numerical designation. Here, the ground plate 50 (FIG. 1, has been removed, as for example where the ground plane conductor 18 is affixed to the mounting flange 42 with a suitable conductive epoxy, not shown.

The transition structure 10 has reciprocity and may be used to either couple power from the waveguide 14 (FIGS. 6 and 7) to the microstrip transmission line 12, or from the microstrip transmission line 12 to the waveguide 14. In addition, the microstrip transmission line 12 may be arranged to have a double-ended port, as shown in FIG. 4 where equivalent elements are designated with the same numerical designations as in FIGS. 1–3 and, where power from the waveguide 14 would be equally split between the two output ports thereof, with a 180 degree phase shift therebetween. Alternatively, one of the two output port may be terminated with an open circuit approximately λ/4 from the coupling slot 22 to provide a single ended output port transition structure. In this latter case, all power to the waveguide 14 will be coupled to the microstrip transmission line 12.

Other embodiments are within the spirit and scope of the appended claims, but are not shown in the drawings. For example, other nominal operating wavelengths may be used. Slot 22 may take a variety of forms, including rectangular, H-shaped, bow-tie shaped, circular, dumbbell shaped, for example. Further, the shape of the conductor 38 may take several possible forms, including square, rectangular, circular, for example.

What is claimed is:

1. A waveguide-microstrip transmission line structure, comprising:

(a) a microstrip transmission line structure having:

(i) a ground plane conductor with slot therethrough;

(ii) strip conductor circuitry separated from the ground plane conductor by a first dielectric layer, such ground plane conductor circuitry and dielectric material providing a strip transmission line, such microstrip transmission line having an open circuit approximately λ/4 from the slot, where λ is the nominal operating wavelength of the structure;

(iii) a conductor separated from the ground plane conductor by a second dielectric layer, such conductor being disposed over the slot and providing an antenna element coupled to the strip conductor circuitry; and (b) a waveguide having conductive walls providing an opening through the waveguide, such walls being electrically connected and mounted to the ground plane conductor with the conductor of the antenna element being disposed within, and spaced from, the walls of the waveguide.

2. The waveguide-microstrip transmission line structure recited in claim 1 wherein the slot is perpendicular to a portion of the strip conductor disposed over such slot.

3. The waveguide-microstrip transmission line structure recited in claim 2 wherein such microstrip transmission line structure is mounted to a mounting flange of the waveguide.

4. The waveguide-microstrip transmission line transition structure recited in claim 1 wherein the conductor is disposed within the waveguide.

5. The waveguide-microstrip transmission line transition section recited in claim 4 wherein such waveguide-microstrip transmission line transition structure is mounted to a mounting flange of the waveguide.

6. The waveguide-microstrip transmission line transition section recited in claim 5 wherein the slot is perpendicular to a portion of the strip conductor disposed over such slot.

7. The waveguide-microstrip transmission line transition structure recited in claim 1 wherein the antenna is a patch antenna configured to provide impedance matching between the waveguide and the microstrip transmission line.

8. A structure, comprising:

(a) a waveguide for propagating energy therethrough along a longitudinal axis; and (b) a microstrip transmission line structure coupled to an open end of said waveguide, such microwave transmission line structure comprising:

(i) a microstrip transmission line having strip conductor circuitry disposed on a first surface of a first dielectric layer and a ground plane conductor disposed on an opposite surface of the first dielectric layer and (ii) an antenna disposed on a second dielectric layer, such second dielectric layer being disposed on the ground plane conductor and electrically coupled to the microstrip transmission line through an aperture in the ground plane conductor, such ground plane conductor being mounted to the open end of the waveguide in a plane intersecting the longitudinal axis of the waveguide.

9. The structure recited in claim 8 wherein the transmission line has an open circuit approximately $\lambda$ from the aperture, where $\lambda$ is the nominal operating wavelength of the structure.

* * * * *